United States Patent [19]

Dupre

[11] 4,059,271

[45] Nov. 22, 1977

[54] HIP MOUNTED TETHERED BALL GAME

[76] Inventor: Herman K. Dupre, Seven Springs, Champion, Pa. 15622

[21] Appl. No.: 708,089

[22] Filed: July 23, 1976

[51] Int. Cl.[2] ..... A63B 67/10; A63B 67/16

[52] U.S. Cl. ..... 273/95 A; 273/58 C; 273/DIG. 19

[58] Field of Search ..... 273/95 A, 26 E, DIG. 19, 273/DIG. 18, DIG. 17, 58 C; 46/51, 52; 224/25 R; 24/3 A

[56] References Cited

U.S. PATENT DOCUMENTS

| | | | |
|---|---|---|---|
| 3,200,536 | 8/1965 | Petitto | 273/DIG. 19 |
| 3,285,482 | 11/1966 | Bedsaul | 224/25 R |
| 3,376,037 | 4/1968 | Lepselter | 273/95 A |
| 3,731,927 | 5/1973 | Rocco | 273/58 C |

FOREIGN PATENT DOCUMENTS

| | | | |
|---|---|---|---|
| 681,775 | 1952 | United Kingdom | 273/95 A |

*Primary Examiner*—Richard C. Pinkham
*Assistant Examiner*—Lawrence Everett Anderson
*Attorney, Agent, or Firm*—Carothers and Carothers

[57] ABSTRACT

A hip mounted tethered ball game wherein a bracket provided with apparatus to attach it to the hip region of a person, holds one end of a line in an extended position from the person's hip region. A ball is tethered to the opposite end of the line in a free swinging fashion. The object of the game is to rotate the tethered ball in vertical circles about its point of attachment to the bracket by utilizing hip movement. The tether line is readily adjusted in length for different swing radii.

5 Claims, 2 Drawing Figures

HIP MOUNTED TETHERED BALL GAME

BACKGROUND OF THE INVENTION

1. Field of the Invention

This invention relates generally to games and more particularly to games utilizing a tethered ball for swinging movement by body action.

2. Discussion of the Prior Art

A number of waist mounted tethered ball games have been invented in the past. Examples of two such games are illustrated in U.S. Pat. Nos. 3,610,622 and 3,782,727. The object of these games is to swing the tethered ball with waist or hip movement in an attempt to lodge the ball into a target.

It is an object of the hip mounted tethered ball game of the present invention to require the person performing the game to coordinate their hip movements in order to get the tethered ball into a continuously vertical swinging orbit. It is a further object to obtain this feat with different lengths of tether line.

SUMMARY OF THE INVENTION

The hip mounted tethered ball game of the present invention comprises a bracket having means to attach the same to a person at the hip region. The bracket extends horizontally outward from the person's hip region and a ball is tethered to the extended end of the bracket with a tether line. The length of the tether line is readily adjustable to provide different swing arcs or swing radii for rotation of the tethered ball about the point where the tether line is attached to the bracket by the use of hip movement.

The extended portion of the bracket comprises a horizontally positioned cone which is provided with a slot therethrough that extends upwardly from the cone tip. A plurality of stops are provided at intervals along the tether line and the diameter of these stops is greater than the width of the slot so that the stops will not pass through the slot. The top of the same slot is provided with a larger opening which is sufficiently large to pass the stops therethrough in order to readjust the tether line length.

A leg rest is preferably provided at the bottom portion of the cone or bracket in order to provide better securement of the cone shaped bracket member to the person's hip region. This leg rest may also be provided with means to secure it to the leg rather than to merely operate as a simple rest.

The top end of the cone shaped bracket is provided with a belt hook for securement to a belt or to the top of one's trousers at the hip region.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 2:
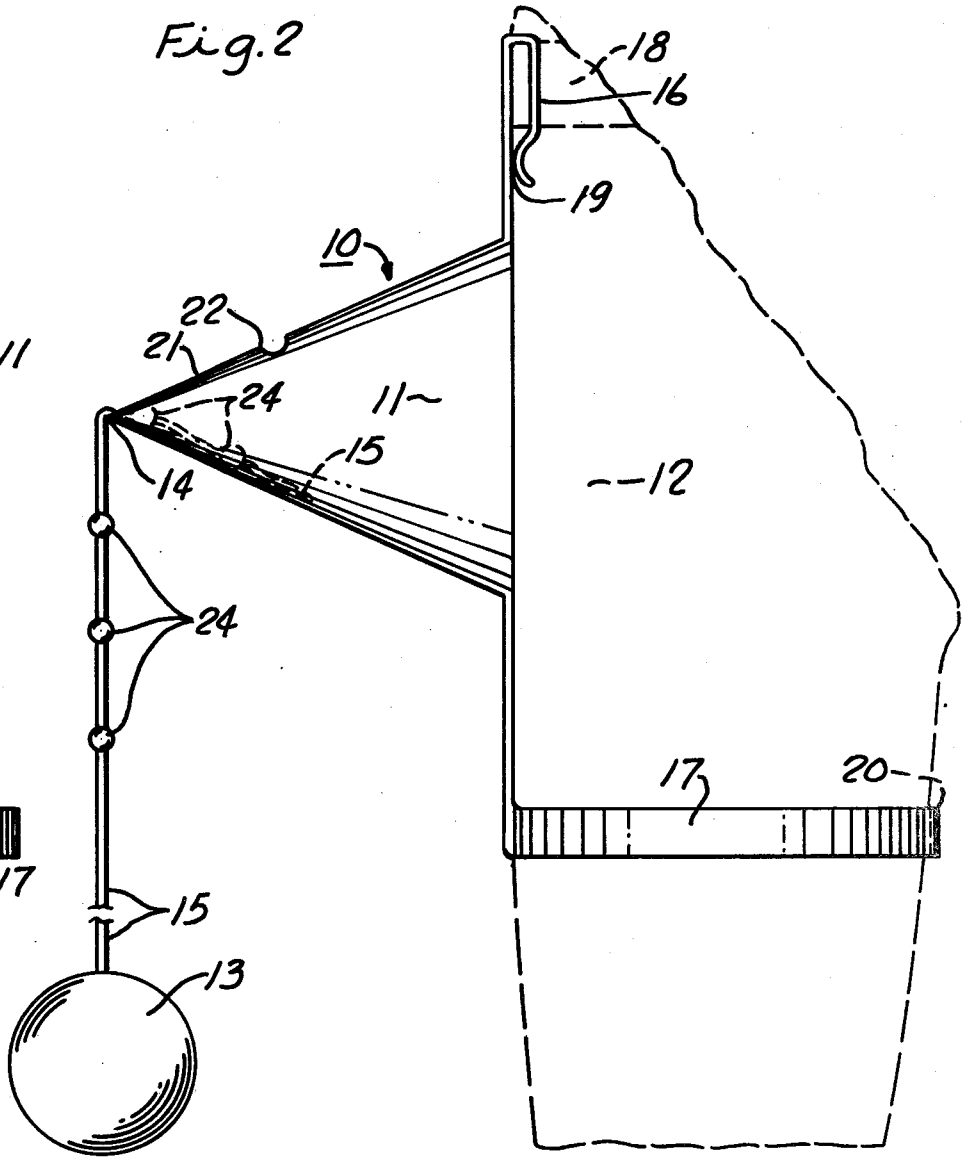
FIG. 2 is a view in side elevation of the hip mounted tethered ball game illustrated in FIG. 1 and further illustrated as being attached to one's person.

Referring to the figures, the hip mounted tethered ball game device 10 of the present invention generally consists of a bracket 11 in the form of a cone that extends horizontally outwardly from the hip region 12 of a person to which it is attached. A ball 13 is tethered to the extended hip 14 of the conical bracket 11 by means of tether line 15.

The entire bracket is secured to the hip region of a person by means of the belt hook 16 at the top and the leg rest and clamp 17 at the bottom.

The entire bracket assembly is preferably formed as one unit and is also preferably unitarily molded of a plastic or shaped from a single piece of metal. The plastic or metal material is sufficiently flexible to permit the belt hook 16 to flex open in order to pass the belt 18 through the bottom opening 19 of the hook 16.

Also, the combination leg rest and clamp 17 may be flexed open at its open end 20 in order to pass the leg of a person therethrough so that it is engaged or clamped by the rest 17. In this manner, the bracket 11 will remain secured at the hip region 12 of the person utilizing the device.

The tether line 15 passes through the upwardly extending slot 21 in the conical shaped bracket 11. The slot 21 extends all the way from the tip of the bracket at 14 to its rearward extent as indicated at 22. At this point, an annular opening 23 is provided to permit passage therethrough of the intervally spaced stops 24 secured to the tether line 15.

Slot 21 is sufficiently wide to permit passage therethrough of the tether line 15, but is too narrow to permit passage therethrough of the beadlike stops 24. The stops 24 may be in the form of a separately secured bead member or may simply consist of knots longitudinally spaced along the flexible tether line 15. Line 15 may be of any suitable flexible material such as string or plastic line and ball 13 will generally consist of solid hard or soft rubber.

The larger upper opening 23 is sufficiently wide in diameter to easily pass the stops 24 therethrough. The length of tether line 15 is thus quickly changed by feeding the tether line 15 upwardly in slot 21, whereupon the stops 24 are fed through opening 23 in either direction as desired to shorten or lenghten the tether line 15. The line 15 is then released so it will slide down slot 21 to the bottom at the tip 14 of the conical shaped bracket 11.

Figure 1:
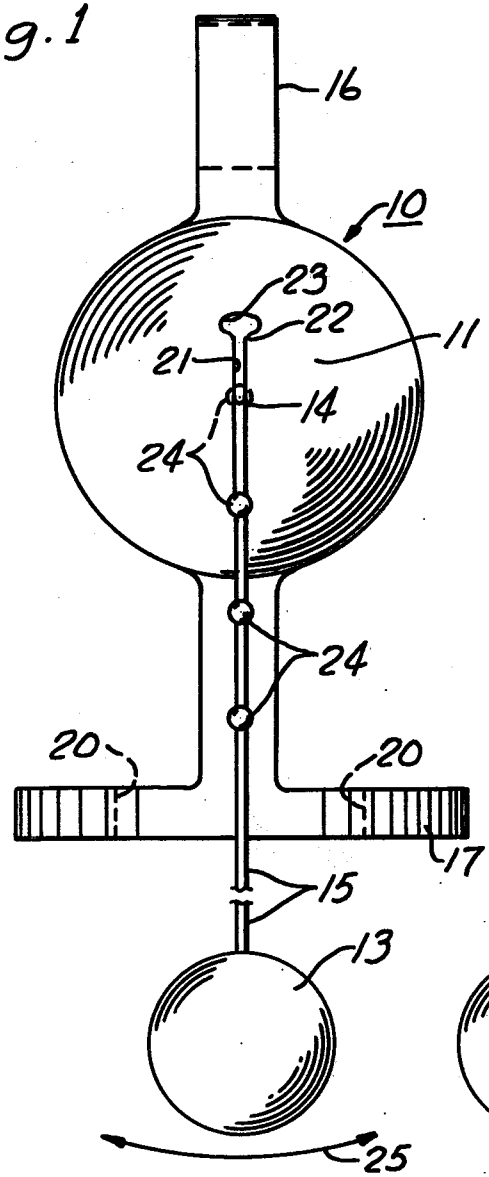
FIG. 1 is a view in side elevation of the preferred embodiment of the hip mounted tethered ball game of the present invention.

Once the device 10 is properly positioned at the hip region 12 as indicated in FIG. 2, the object of the game is then the person wearing the device to start movement of the ball 13 about point 14 of the bracket in vertical circles as indicated by the double curved arrow 25 in FIG. 1. The person does this by making hip movements to get the ball swinging as indicated at 25 in an attempt to eventually cause the ball 13 to continuously swing in vertical circular orbits about point 14 of the bracket 11. This requires considerable skill and trial and error upon the person attempting to do so in order to develop sufficient coordination of hip movement to obtain the objective. In addition, by changing the length of the tether 15, competition between performers is enhanced, as the coordination movements of the hips required to swing the ball at one radius are different than that required to swing the ball in orbit at different radii.

I claim:

1. A hip mounted tethered ball game comprising a bracket having means to attach the same to a person at the hip region, said bracket having an extended portion to extend outwardly from a person's hip region, and a ball tethered to the extended end of said bracket by a tether, said bracket consisting of a horizontally positioned cone having a slot therethrough extending upwardly from the cone tip, at least one stop on said tether being larger in cross section than said tether, said slot being sized to pass said tether therethrough but too narrow to pass said stop, and an opening at the upward end of said slot sufficiently large to pass said stop therethrough.

2. The hip mounted tethered ball game of claim 1 including a plurality of said stops positioned along said tether.

3. The hip mounted tethered ball game of claim 1 wherein said means to attach said bracket at the hip region of a person includes a leg rest at the bottom of said cone.

4. The hip mounted tethered ball game of claim 3 including means to secure said leg rest to a person's leg.

5. The hip mounted tethered ball game of claim 1 wherein said means to attach said bracket to a person at the hip region inludes an upwardly extending belt hook secured to the upper base portion of said cone.

* * * * *